US005238806A

United States Patent [19]

Hashi

[11] Patent Number: 5,238,806

[45] Date of Patent: Aug. 24, 1993

[54] SILVER HALIDE PHOTOGRAPHIC LIGHT-SENSITIVE MATERIAL

[75] Inventor: Yoshihisa Hashi, Shizuoka, Japan

[73] Assignee: Fuji Photo Film Co., Ltd., Kanagawa, Japan

[21] Appl. No.: 773,001

[22] Filed: Oct. 8, 1991

[30] Foreign Application Priority Data

Oct. 9, 1990 [JP] Japan ..... 2-272018

[51] Int. Cl.[5] ..... G03C 1/18

[52] U.S. Cl. ..... 430/588; 430/611; 430/614; 430/966; 430/599; 430/569

[58] Field of Search ..... 430/588, 611, 614, 966, 430/599, 569

[56] References Cited

U.S. PATENT DOCUMENTS 4,689,292 8/1987 Metoki et al. ..... 430/567
4,952,491 8/1990 Nishikawa et al. ..... 430/570

FOREIGN PATENT DOCUMENTS 63-060447 3/1988 Japan ..... 430/567
1-026836 1/1989 Japan ..... 430/966
2-027340 1/1990 Japan ..... 430/614

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

There is disclosed a silver, halide photographic light-sensitive material having a high sensitivity and gradation as well as a low fog while exhibiting an excellent aging stability. The light-sensitive material has at least one silver halide emulsion layer on a support, wherein the emulsion is spectrally sensitized at a pH of 5.3 to 6.0 by adding at least one of an oxacarbocyanine dye represented by the following formula (I) to the emulsion before the addition of a chemical sensitizer and thereafter chemically sensitized by adding a chemical sensitizer. A compound represented by the following formula (II) is present in the emulsion layer or a layer adjacent thereto:

(I)

(II)

wherein the substituents are as defined in the specifications.

7 Claims, No Drawings

SILVER HALIDE PHOTOGRAPHIC LIGHT-SENSITIVE MATERIAL

FIELD OF THE INVENTION

The present invention relates to a silver halide photographic light-sensitive material, in particular to an X-ray photographic light-sensitive material capable of providing an image with a high gradation and less fog at a high sensitivity while maintaining an excellent aging stability.

BACKGROUND OF THE INVENTION

A black and white silver halide photograph is developed to form a visible image. In medical radiography, an illness is diagnosed by the density of a silver image. When a trouble area in which the difference in transmittance of an X-ray is small is observed, an image having a high gradation and a sharp outline is required. In recent years, as diagnosis becomes more precise and there are more cases in which a soft tissue such as a breast is observed, the requirement for high gradation and sharp outline increases.

In diagnosing a breast cancer, the system of a screen on one side and a film on the other side is preferably used because there is a serious need for a sharpness. However, that system shows a low sensitivity when subjected to standard processing as compared to those systems in which screens and emulsion layers are on both sides. Therefore, there are some cases in which the developing temperature must be raised and the developing time prolonged in order to obtain the needed characteristics of high sensitivity and gradation.

Fog caused in such processing results in worse image contrast and a deterioration of visible sharpness. Fog is likely to increase, especially when a light-sensitive material is processed at a high temperature where the KBr amount in a developing solution is decreased.

SUMMARY OF THE INVENTION

The object of the present invention is to provide an X-ray photographic light-sensitive material which is capable of providing an image having no fog even if it is subjected to the development at a high temperature over a long period of time and which has the characteristics of high sensitivity and gradation.

In the present invention, as the result of the extensive research and development, it has been found that the combination of the following emulsion and compounds can surprisingly provide a low fog and a high sensitivity and gradation, as well as an excellent aging stability.

The above object of the present invention has been achieved by a silver halide photographic light-sensitive material comprising a support. Provided thereon is at least one silver halide emulsion layer, wherein the emulsion is spectrally sensitized at a pH of 5.3 to 6.0 by adding at least one of an oxacarbocyanine dye represented by the following formula (I) before the addition of a chemical sensitizer and thereafter chemically sensitized by adding a chemical sensitizer; and wherein a compound represented by the following formula (II) is present in the emulsion layer or a layer adjacent thereto:

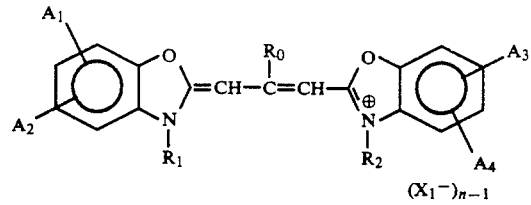

(I)

wherein $A_1$, $A_2$, $A_3$ and $A_4$, each represents a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamide group, an acyl group, an acyloxyl group, an alkoxycarbonylamino group, and a carboalkoxy group, provided that $A_1$ and $A_2$, and $A_3$ and $A_4$ may combine with each other to form a naphthoxazole nucleus; $R_0$ represents a hydrogen atom, a lower alkyl group, and an aryl group; $R_1$ and $R_2$ each represents an alkyl group, provided that at least one of $R_1$ and $R_2$ is an alkyl group having a sulfo radical; $X_1$ represents an anion; and n is 1 or 2, provided that when the dye forms an inner salt, n is 1;

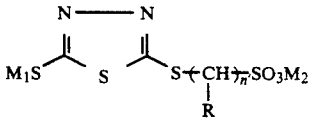

(II)

wherein $M_1$ and $M_2$ each represents a hydrogen atom, an alkali metal atom (e.g. lithium, sodium and potassium), and an ammonium ion, wherein $M_1$ and $M_2$ may be the same or different; n' represents an integer of 1 to 8, especially 1 to 4; and R represents a hydrogen atom or an alkyl group having 1 to 6 carbon atoms, especially 1 to 4 carbon atoms (e.g. methyl, ethyl, propyl, isopropyl and butyl), wherein the R groups may be the same or different from each other when n' is 2 or more.

DETAILED DESCRIPTION OF THE INVENTION

In formula (I), the alkyl group and the alkyl moiety of the other groups (e.g., the alkyl moiety of the acyloxy group) represented by $A_1$ to $A_4$ preferably have 1 to 4 carbon atoms, and the aryl group for $A_1$ to $A_4$ preferably has 6 carbon atoms. The alkyl group for $R_0$ preferably has 1 or 2 carbon atoms, and the aryl group for $R_0$ preferably has 6 carbon atoms. The alkyl group for $R_1$ and $R_2$ preferably has 2 to 4 carbon atoms, and the anion for $X^-$ is preferably $Br^-$ or $I^-$.

The preferable examples of the dye represented by formula (I) are shown below:

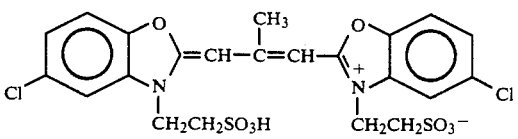

I-1

-continued
I-2
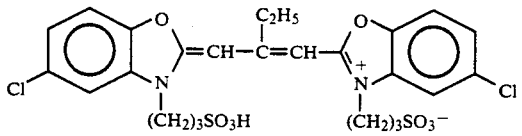
I-3
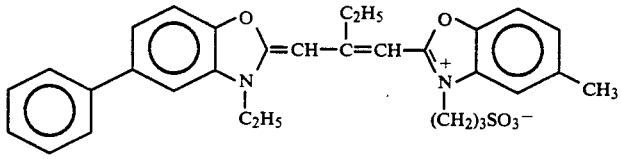
I-4
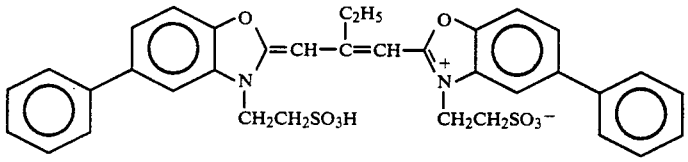
I-5
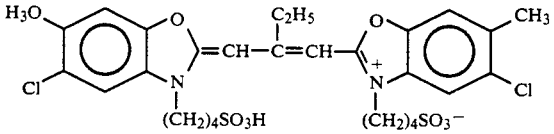
I-6
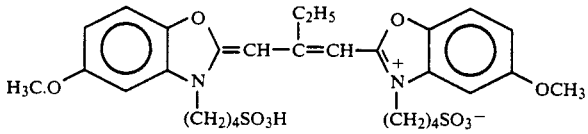
I-7
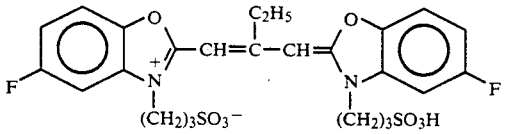
I-8
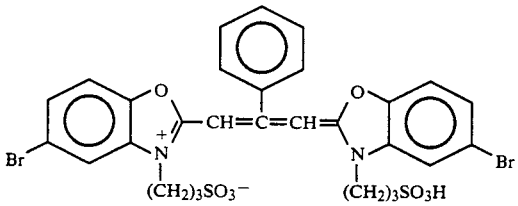
I-9
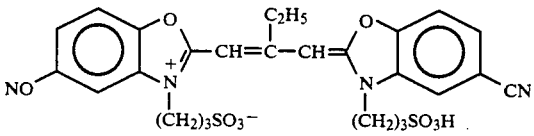
I-10
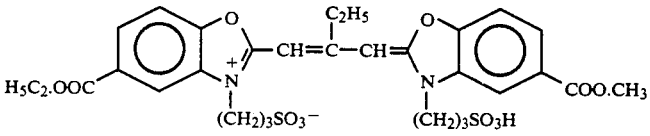
I-11
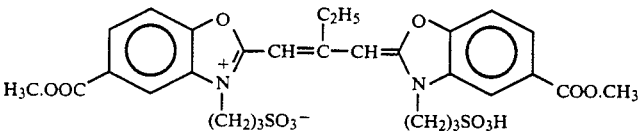

-continued
I-12
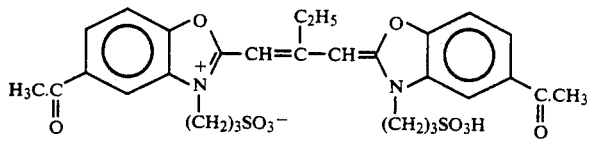
I-13
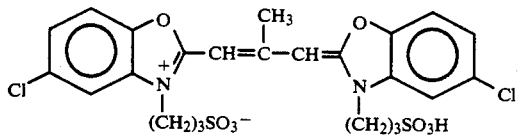
I-14
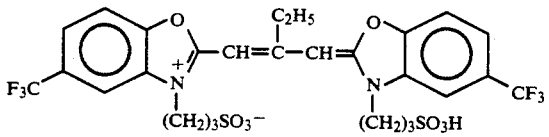
I-15
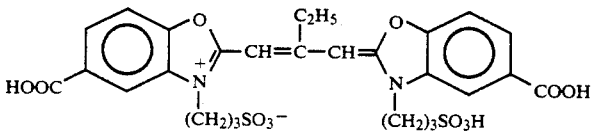
I-16
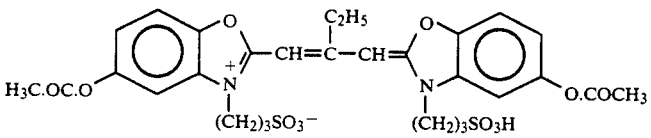
I-17
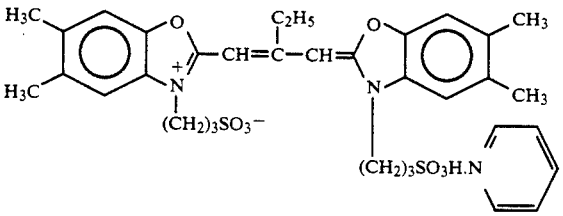
I-18
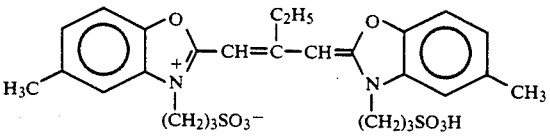
I-19
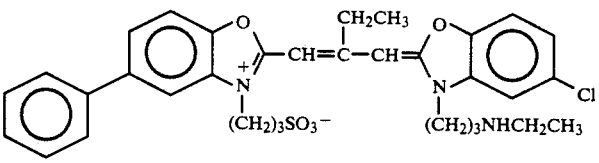
The preferable examples of the compounds represented by formula (II) are shown below:
(1)
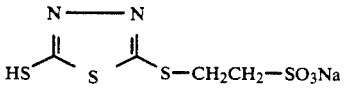
(2)
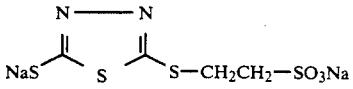
-continued
(3)
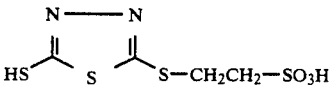
(4)
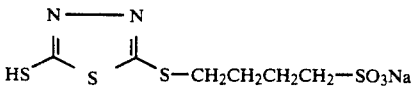

-continued (5)

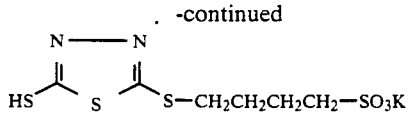

(6)

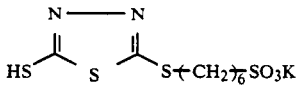

(7)

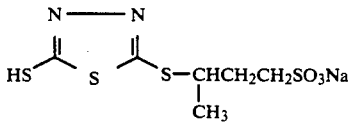

(8)

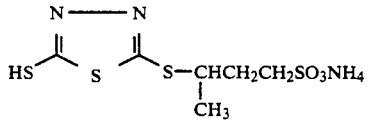

It is already known that 5-mercapt-1,3,4-thiadiazoles are incorporated into a photographic light-sensitive material or a processing solution [for example, U.S. Pat. Nos. 2,573,027, 2,743,184, 3,048,486, 3,063,837, and 3,330,657; British Patents 737,568, 940,169, 959,182, 1,032,091, 1,058,488, 1,138,842, 1,143,171, and 1,177,287; German Patents (OLS) 1,804,365, 1,930,338, and 2,109,334; JP-B-44-2544 (the term "JP-B" as used herein means an examined Japanese patent publication); JP-A-51-102639 (the term "JP-A" as used herein means an unexamined published Japanese patent publication)]. These compounds are used for the purposes of preventing bronzing, stabilization of a silver image, improvement of graininess, stabilization of a developing solution, and prevention of fog caused in color developing at a high temperature. Still, it is not known and entirely unexpected that the combination of the emulsions subjected to specific spectral sensitization and mercapto thiadiazoles can provide a high sensitivity and gradation as well as low fog.

The addition amount of the oxacarbocyanine dye represented by formula (I) is 0.05 millimole to 5 millimole, preferably 0.1 millimole to 1 millimole, per mole of silver.

The compound represented by formula (II) is used usually in an amount of 0.01 millimole to 5 millimole, preferably 0.1 millimole to 1.0 millimole, per mole of the sensitized silver contained in the same layer or a layer adjacent thereto.

In the present invention, the sensitizing dye represented by formula (I) is preferably added to a silver halide emulsion at 50° C. or higher and a pH of 5.4 to 5.6 after washing with water but before adding a chemical sensitizer.

The compound represented by formula (II) may be added at the final stage of chemical ripening or just before coating. It may be added to the emulsion or an adjacent protective layer-coating solution.

The silver halides for a light-sensitive silver halide emulsion used in the invention are silver bromochloride, silver bromide, silver bromoiodide and silver bromochloroiodide, preferably silver bromoiodide. The content of silver iodide is preferably 30 mol% or less, more preferably 10 mol% or less. The distribution of iodine in the silver bromoiodide grains may be the same or different in an interior and the surface area.

The size of the silver halide grains is preferably 4 μm or less, more preferably 0.1 to 2.0 μm, provided that the grain size is defined by the diameter of the sphere having the same volume as that of the silver halide grain. The distribution of the silver halide grain sizes may be either narrow or broad.

The silver halide grains contained in the emulsion may have a regular crystal form such as cube, octahedron, tetradecahedron and rhombic dodecahedron, or an irregular crystal form such as sphere, plate and potato shape. The crystal form may be a composite form of these crystal forms. It may comprise a mixture of the various crystal form grains. The tabular grains having the grain size five times as large as the thickness thereof are preferably used in the invention (more details are described in *Research Disclosure*, Jan. 1983, Vol. 225, Item 22534, pp 20 to 58, and JP-A-58-127921 and JP-A-58-113926).

The photographic emulsions used in the invention can be prepared by the methods described in Chimie et *Physique Photographique* by P. Glafkides (published by Paul Montel Co., 1967); *Photographic Emulsion Chemistry* by G. F. Duffin (published by The Focal Press, 1966); *Making and Coating Photographic Emulsion* by V. L. Zelikman et al (published by The Focal Press, 1964); and JP-A-58-127921 and JP-A-58-113926. The preparation method may be an acid method, a neutral method and an ammonia method. The manner of reacting a water-soluble silver salt with a water-soluble halide may be a single-jet method, a double-jet method or the combination thereof. It is also possible to apply a so-called reverse mixing method in which the silver halide grains are formed in the excess of silver ions. There can be applied as well a so-called controlled double-jet method, a form of the double-jet method in which the pAg of the silver halide-forming solution is maintained silver halide emulsion comprising the silver halide grains having regular crystal forms and almost uniform grain sizes can be obtained by this method.

The silver halide grains may have a wholly uniform silver halide composition throughout the grain; a stratum structure in which a silver halide composition of an inside stratum is different from that of an outer stratum; a so called conversion type described in British Patent 635,841 and U.S. Pat. No. 3,622,318; an epitaxial structure in which silver halide grains having different compositions are bound by an epitaxial binding; or a structure in which the silver halide grains are bound to rhodan silver, silver oxide and the like. The silver halide grains may be either a surface latent image type or an internal latent image type. In the process of silver halide grain formation in the preparation of silver halides or a physical ripening, there may coexist a potassium salt, a rhodium salt or a complex salt thereof, and iron salt or a complex salt thereof in addition to the above iridium salt.

Further, so-called silver halide solvents such as ammonia, thioether compounds; thiazolidine-2-thiones, four-substituted thiourea, potassium rhodanide, ammonium rhodanide and amine compounds may be added to control a grain growth.

The silver halide emulsions used in the invention must be chemically sensitized. The chemical sensitization can be carried out by known methods such as a sulfur sensitization, a reduction sensitization, and a gold sensitization, and they may be used singly or in combination thereof.

The gold sensitization is typical of the noble metal sensitizations, in which a gold compound, mainly a gold complex salt, is used. Noble metals other than gold, e.g. the complex salts of platinum and palladium, may be contained. The examples thereof are described in U.S. Pat. No. 2,448,060 and British Patent 618,061.

Various sulfur compounds such as thiosulfate salts, thioureas, thiazoles and rhodanines can be used as a sulfur sensitizer. Examples thereof are described in U.S. Pat. Nos. 1,574,944, 2,278,947, 2,410,689, 2,278,668, 3,501,313, and 3,656,955.

Stannous compounds, amines, formamidine sulfinic acids and silane compounds can be used as a reduction sensitization. Examples thereof are described in U.S. Patents 2,487,850, 2,518,698, 2,983,609, 2,983,610, and 2,694,637. These sensitizers are added after adding the dyes of formula (I).

In the present invention, a particularly prefer able pH in the chemical sensitization is 5.4 to 5.6.

In the present invention, the light-sensitive silver halide emulsions may be used in a combination of two or more kinds of emulsions. The emulsions to be mixed may be different in grain-size, halide composition and sensitivity. Substantially non-light-sensitive emulsions, the surface or inside of which may or may not be fogged, and light-sensitive emulsions may be used in mixture or added to the different layers, respectively. More details are described in U.S. Pat. Nos. 2,996,382 and 3,397,987. For example, a light-sensitive emulsion comprising spherical or potato-shape silver halide grains and a light-sensitive emulsion comprising tabular silver halide grains having a grain size five times as large as the thickness thereof may be added to the same layer or the different layers as described in JP-A 58-127921. When it is added to the different layers, a light-sensitive silver halide emulsion comprising tabular silver halide grains may be added to either the layer close to or the layer far from the support.

The photographic emulsions used in the present invention may contain various compounds in addition to the above compounds to prevent fog during the preparation and storage of the light-sensitive materials and to stabilize photographic properties. The examples thereof are azoles such as benzothiazolium salts, nitroimidazoles, nitrobenzimidazoles, chlorobenzimidazoles, bromobenzimidazoles, nitroindazoles, benzotriazoles, and aminotriazoles; mercapto compounds such as mercaptotetrazoles, mercaptothiazoles, mercaptobenzothiazoles, mercaptobenzimidazoles, mercaptothiadiazoles, mercapto pyrimidines, and mercaptotriadines; thioketo compounds such as oxazolinethions; azaindenes such as triaza indenes, tetrazaindenes [in particular, 4-hydroxy substituted (1,3,3a,7)tetrazaindenes], and pentazaindenes; and many compounds which are known as antifoggants and stabilizers, such as benzenethiosulfonic acid, benzenesulfinic acid, and benzene-sulfonic amide. More details are described in *Research Disclosure*,Item 17643, Paragraph IV, pp. 24 to 25, December 1978, and in the documents cited therein. Among them, particularly preferred are nitrons and the derivatives thereof described in JP-A-60 76743 and JP-A-60-87322; mercapto compounds described in JP-A-60-80839; heterocyclic compounds described in JP-A-57-16473; and the comple salts of heterocyclic compounds and silver (e.g. silver 1-phenyl-5-mercaptotetrazole).

The light-sensitive silver halide emulsions used in the present invention is spectrally sensitized to green light in a relatively long wavelength region. In addition to the dyes represented by formula (I), the dyes described in *Research Disclosure*, Item 17643, Paragraph VI-A (1978, pp. 23) or in the documents cited therein can be used as the sensitizers.

The sensitizing dyes are added preferably during chemical ripening in the preparation of the photographic emulsions, in particular with the emulsions at 50° C. or higher and pH of 5.3 to 6.0 before adding chemical sensitizers.

The photographic emulsion layers and other hydrophilic colloid layers of the light-sensitive materials prepared according to the present invention may contain various surfactants as a coating aid, to prevent electrification, to improve sliding, for emulsification-dispersion, to prevent sticking, and to improve the photographic characteristics (e.g. acceleration of development, harder gradation and sensitization).

The examples thereof are nonionic surfactants such as saponin (steroid type), alkylene oxide derivatives (e.g. a polyethylene glycol/polypropylene glycol condensation product, polyethylene glycol alkyl ethers, polyethylene glycol alkyl aryl ethers, polyethylene glycol esters, polyethylene glycol sorbitan esters, polyalkylene glycol alkylamines or amides, and adducts of silicon and polyethylene oxide), glycidols (e.g. alkenylsuccinic acid polyglycerides and alkylphenol polyglycerides), fatty acid esters of polyhydric alcohol, and alkylesters of sucrose; anionic surfactants having acid groups such as a carboxy group, a sulfo group, a phospho group, a sulfate group and a phosphate group, such as alkylcarbonic acid salts, alkylsulfonic acid salts, alkylbezenesulfonic acid salts, alkylnaphthalenesulfonic acid salts, alkyl sulfates, alkyl phosphates, N-acyl-N-alkyltaurines, sulfosuccinates, sulfoalkyl polyoxyethylenealkylphenyl ethers, and polyoxyethylenealkyl phosphates; amphoteric surfactants such as amino acids, aminoalkyl sulfonates, aminoalkyl sulfates, aminoalkyl phosphates, alkylbetains, and amine oxides; and cationic surfactants such as alkylamine salts, aliphatic or aromatic quaternary ammonium salt, heterocyclic quaternary ammonium salts such as pyridiniums and imidazoniums, and alipha tic or heterocycle-containing phosphonium or sulfonium compounds.

The preferable antistatic agents are the fluorinated surfactants or polymers described in JP-A-59-74554, JP-A-60-80849, JP A-62-109044 and JP-A-62-215272; the nonionic surfactants described in JP-A-60-76742, JP-A-60-80846, 60 80848, JP-A-60-80839, JP-A-60-76741, JP-A-58-208743, JP-A-62-172343, JP-A-62-173459, and JP-A-62-215272; and the electroconductive polymers or latexes (nonionic, anionic, cationic and amphoteric) as described in JP-A-57-204540 and JP-A-62-215272. The preferable inorganic antistatic agents are halides, nitric acid salts, perchloric acid salts, sulfuric acid salts, acetic acid salts, phosphoric acid salts and thiocyanic acid salts of ammonium, alkaline metals and alkaline earth metals, as well as electroconductive tin oxide, zinc oxide and antimony-doped oxides of these metals, each described in JP-A 57-118242.

In the present invention, there can be used as a matting agent the organic compounds such as a homopolymer of polymethyl methacrylate or a copolymer of methyl methacrylate and methacrylic acid described in U.S. Pat. Nos. 2,992,101, 2,701,245, 4,142,894 and 4,396,706, and starch; other matting agents include fine particles of inorganic compounds such as silica, titanium oxide, strontium sulfate, and barium sulfate. The particle size thereof is preferably 0.5 to 10 μm, particularly 1 to 5 μm.

The examples of the sliding agent used for the photographic light-sensitive material of the present invention include paraffin waxes, higher fatty acid esters and starch derivatives as well as the silicon compounds described in U.S. Pat. Nos. 3,489,576 and 4,047,958 and colloidal silica described in JP-B-56-23139.

Polyols such as trimethylol propane, pentanediol, butanediol, ethylene glycol and glycerine can be used as a plasticizer for a hydrophilic colloid layer of the photographic light-sensitive material of the invention. Further, the hydrophilic colloid layer preferably contains polymer latexes for the purpose of improving its anti-pressure property. The examples of the polymer used preferably therefor include a homopolymer of alkyl acrylate, a copolymer of alkyl acrylate and acrylic acid, a styrene-butadiene copolymer, and a polymer or copolymer consisting of a monomer having an active methylene group.

In the present invention, the photographic emulsion layers and/or the other hydrophilic colloid layers may contain the composite latexes described in JP-A-62-335570.

The photographic emulsions and non-light-sensitive hydrophilic colloids used in the invention may contain an inorganic or organic hardener. The examples thereof include chromium salts (chromium alum), aldehydes (e.g. formaldehyde), N-methylol compounds, dioxane derivatives, active vinyl compounds (e.g. 1,3,5-triacryloylhexahydro-s-trazine, bis(vinylsulfonyl) methyl ether and N,N'-methylenebis-[β-(vinylsulfonyl) propionamide]), active halogen compounds (e.g. 2,4-dichloro-6-hydroxy-s-trazine), and mucohalogen acids (e.g. mucochloric acid). They can be used singly or in a combination thereof. Preferred among them are the active vinyl compounds described in JP-A-53-41220, JP-A-53-57257, JP-A-59 162546 and JP-A-60-80846 and the active halogen compounds described in U.S. Pat. No. 3,325,287.

Where the light-sensitive material of the invention is used as an X-ray-sensitive material, the hydrophilic layers are hardened preferably with the above hardeners so that the swelling ratio in water defined by the ratio of a thickness swollen in distilled water at 21° C. for 3 minutes to a dry thickness is 300% or less, particularly 250% or less.

Gelatin is preferably used as a binder or protective colloid which can be used for the emulsion layers and intermediate layers of the light-sensitive material of the invention, but other hydrophilic colloids can be used as well. There can be used various kinds of the synthetic hydrophilic polymer compounds including proteins such as gelatin derivatives, graft polymers of gelatin and other polymers, albumin, and casein; cellulose derivatives such as hydroxyethyl cellulose, caboxymethyl cellulose and cellulose sulfate; sucrose derivatives such as sodium alginate, dextrane and starch derivatives; homopolymers and copolymers such as polyvinyl alcohol, partially acetalized polyvinyl alcohol, poly-N-vinylpyrrolidone, polyacrylic acid, polymethacrylic acid, polyacrylamide, polyvinyl imidazole, and polyvinyl pyrazole.

As the gelatin, there can be used acid-treated gelatin and enzyme-treated gelatin in addition to limetreated gelatin. Hydrolysis products of gelatin can be used as well. Among them, gelatin is preferably used in combination with dextrane and polyacrylamide.

The silver halide photographic light-sensitive material of the invention may have non-light sensitive layers such as a surface protective layer, an intermediate layer and an anti halation layer in addition to the light-sensitive silver halide emulsion layers.

The silver halide emulsion layers may comprise two or more layers, wherein the respective layers may have different sensitivities and gradations. One or more silver halide emulsion layers and non light sensitive layers may be provided on both sides of a support.

The preferable supports for the light-sensitive materials are a polyethylene terephthalate film and a cellulose triacetate film, and in particular, they are preferably blue-colored.

The supports are subjected preferably to a corona-discharge treatment, a glow-discharge treatment and a UV-irradiation treatment in order to increase adhesiveness to a hydrophilic colloid layer. They may be provided with a subbing layer comprising a styrene-butadiene latex and a vinylidene chloride latex and may be further provided thereon with a gelatin layer. Further, there may be provided with a subbing layer comprising a polyester swelling agent and gelatin-containing organic solvent. These subbing layers can be subjected to a surface treatment in order to further increase their adhesiveness to a hydrophilic colloid layer.

The present invention can be applied to any photographic light-sensitive materials to the extent that they are subjected to conventional development processing. For example, it can be used as an X-ray photographic light-sensitive material, a lithographic photographic light-sensitive material, a black and white negative photographic light-sensitive material, a color negative light-sensitive material, a color reversal light-sensitive material, a color paper light-sensitive material, and a black and white light-sensitive paper.

Where the light-sensitive material of the invention is used as an X-ray photographic light-sensitive material, there are preferably applied thereto a stabilizer, an anti-foggant and a kink mark preventing agent disclosed in *Research Disclosure*, Item 18431 (pp. 433 to 441, August 1979), the technology regarding a protective layer (pp. 436, paragraph IV), and the technology for controlling a crossover (pp. 436, paragraph V).

The light-sensitive material of the invention may be exposed in a conventional manner to obtain an X-ray photographic image, in which the X-ray is irradiated directly on the light-sensitive material having the light-sensitive layers on both sides thereof or the light-sensitive material sandwiched with fluorescence-sensitizing papers or lead foil-sensitizing papers. In case of a light-sensitive material having a light-sensitive layer on only one side thereof, it is exposed in such manner that the X-ray is irradiated on the fluorescence-sensitizing paper to record an emitted light on the light-sensitive material. It also is possible to irradiate the X-ray on the light-sensitive material contacted to a fluorescence-sensitizing paper. There can be used a fluorescent substance such as blue-luminant calcium tangstate and barium sulfate, and a green-luminant rare earth fluorescent substance. Further, the fluorescent substance is exposed to the X-ray and then can be exposed to the various light sources including an infrared ray, such as a cathode-ray tube flying spot, a light-emitting diode, a laser light (e.g. a gas laser, a YAG laser, a dye laser and a semiconductor laser).

Hydroquinones are preferably used as the developing agent in the developing solution for the light-sensitive material of the invention. The combination of hydroquinones and 1-phenyl-3-pyrazolidones or hydroquinones and p-aminophenols is preferable because it is easy to obtain excellent properties with those combinations.

The examples of the hydroquinone developing agent used in the invention are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, and hydroquinone monosulfonate. Among them, hydroquinone is particularly preferred.

The examples of the p-aminophenol developing agent used in the invention include N-methyl-p-aminophenol, p-aminophenol, N-(β-hydroxyethyl)-p-aminophenol, N-(4-hydroxyphenyl) glycine, 2-methyl p-aminophenol, and p-benzyl aminophenol. Among them, N-methyl-p-aminophenol is preferred.

The examples of the 3-pyrazolidone developing agent are 1-phenyl-3-pyrazolidone, 1-phenyl-4,4-dimethyl-3-pyrazolidone, 1-phenyl-4-methyl-4 hydroxymethyl-3-pyrazolidone, 1-phenyl-4,4-dihydroxymethyl 3-pyrazolidone, 1 phenyl-5-methyl-3-pyrazolidone, 1 p-dimethyl-3-pyrazolidone, and 1-tolyl-4-methyl-4-hydroxymethyl-3-pyrazolidone.

The hydroquinone developing agent is used usually in an amount of 0.01 to 1.5 mol/liter, preferably 0.05 to 1.2 mol/liter.

In addition thereto, the p-aminophenol develop ing agent or the 3-pyrazolidone developing agent is used usually in an amount of 0.0005 to 0.2 mol/liter, preferably 0.001 to 0.1 mol/liter.

The examples of a sulfite used in the developing agent in the invention include sodium sulfite, potassium sulfite, lithium sulfite, ammonium sulfite, sodium bi-sulfite, and potassium metabisulfite. The sulfite is used in an amount of 0.3 mol/liter or more, preferably 0.4 mol/liter or more. The upper limit thereof is preferably 2.5 mol/liter in a conc. developing solution.

The light-sensitive material of the invention can also be photographically processed with a developing agent containing imidazoles as a silver halide solvent as described in JP-A-57-78535. It also is possible to process the light-sensitive material with the developing solution containing the additives such as silver halide solvents described in JP-A-58-37643 and indazole or triazole. In addition to the above compounds, the developing solution may contain conventional additives such as a preservative, an alkali agent, a pH buffer solution and an anti-foggant, and if necessary, may further contain a dissolution aid, a color toning agent, a development accelerator, a surfactant, a defoaming agent, a softening agent, a hardener (e.g. glutaraldehyde), and a tackifier.

A fixing solution having a conventional composition can be used. In addition to thiosulfates and thiocyanates, the organic sulfur compounds known as being effective as fixing solutions can be used as the fixing agent. The fixing agent may contain a water-soluble aluminium salt as a hardener.

In the present invention, the development processing is carried out preferably with the roller-transporting type automatic developing machines described in U.S. Pat. Nos. 3,025,779, 3,515,556, 3,573,914, and 3,647,459, and British Patent 1,269,268.

The developing temperature is 18° to 50° C., preferably 30° to 40° C. The developing time is 5 seconds to 5 minutes, preferably 10 seconds to 4 minutes.

The total processing time in all the processing steps of developing, fixing, washing and drying is 30 seconds to 10 minutes, preferably 40 seconds to 7 minutes.

EXAMPLES

The effects of the present invention are explained below in more detail.

EXAMPLE 1

A potassium bromide solution and an ammonical silver nitrate solution were regularly added to a gelatin solution which already contained potassium iodide and potassium bromide by a double-jet method to prepare twinned, polydispersed silver iodobromide grains having an iodide content of 2.5 mol% (an average grain size: 0.75 μ).

After being washed with water, gelatin 43 g per 100 g of silver nitrate was added to the above emulsion and the pH was adjusted to 5.5 to obtain an emulsion not chemically ripened (hereafter referred to as "non-CR emulsion").

The sulfur compounds described in U.S. Pat. No. 1,574,944 and potassium bichloraurate were added to this non CR emulsion at 57° C. for chemical sensitization and then, sodium anhydro-5,5-dichloro-g-ethyl 3,3-di(3-sulfopropyl)oxacarboncyanine of Dye (I) shown below was added thereto to prepare the Emulsion E-1.

Dye (I) was added to the non-CR emulsion at 57° C. and pH 5.5 and then, the sulfur compound and potassium bichloraurate were added to prepare the chemically sensitized Emulsion E-2.

Dye (I) was added to the non-CR emulsion at 57° C. and pH 6.1 and then the sulfur compound and potassium bichloraurate were added to prepare the chemically sensitized Emulsion E-3.

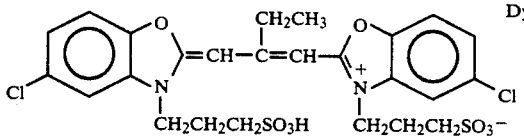

The samples worth evaluating could not be prepared at pH lower than 5.3 due to flocculation of the gelatin and deterioration of the coating characteristic.

Added to the emulsions thus prepared was 4-hydroxy-6-methyl-1,3,3a,7-tetrazaindene (the coating procedure A), and sodium 2 mercapto-5-butylmercaptosulfonate-1,3,4-thiazole of Compound (II) shown below was added in an amount of 0.5 millimole/mol Ag (the coating procedure B).

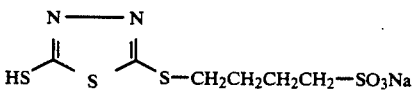

There was prepared the gelatin solution for a protective layer containing a coating aid comprising a bis type polyethylene oxide, a fluorinated hydrocarbon surfactant and an anionic surfactant, a matting agent of polymethyl methacrylate grains having an average grain size of 2.0 μm, a polysiloxane sliding agent, a hardener [N,N'-methylenenbis(8-vinylsulfonyl) propionamide], and a preservative (β-oxyphenyl ether).

The emulsion layer and protective layer were simultaneously coated on a PET support having an anti-halation layer provided in advance on the side opposite to the emulsion layer so that the silver amount coated on one side of the support was 4.5 g/m$^2$.

Thus, the six samples were prepared in the combinations as shown below:

| Sample No. | Em No. | Coating procedure |
|---|---|---|
| 1 | E-1 | A |
| 2 | E-1 | B |
| 3 | E-2 | A |
| 4* | E-2 | B |
| 5 | E-3 | A |
| 6 | E-3 | B |

*Invention

These samples were exposed to an X-ray at 50 KV and 100 mA exciting a fluorescence-sensitizing paper HR-2 manufactured by Kasei Optonics Co. and at varying distances. The exposed samples were subjected to the development processing with an automatic developing machine FPM-4000 manufactured by Fuji Photo Film Co., Ltd. using a developing solution RD-V containing KBr of 4 g/liter, manufactured by Fuji Photo Film Co., Ltd., at 35° C. for 90 seconds on a dry to dry basis. Then, the photographic properties of the processed samples were evaluated and the results thereof are shown in Table 1.

The exposed samples were subjected to the development processing with FPM-4000 using RD- containing KBr of 4 g/liter at 37° C. for 3 minutes and 30 seconds on a dry to dry basis. Then, the photographic properties of the processed samples were evaluated and the results thereof are shown in Table 2.

The exposed samples were subjected similarly to development processing using RD-V, in which the starter amount was reduced to one half of the ordinary amount under the condition of potassium bromide 2 g/liter at 37° C. for 3 minutes and 30 seconds on a dry to dry basis. The photographic properties of the developed samples were evaluated and the results thereof are shown in Table 3.

The photographic density was measured with an automatic densitometer manufactured by Fuji Photo Film Co., Ltd. The photographic sensitivity is expressed by the reciprocal of the exposure necessary to give the graphic density of fog plus 1.0 and shown by the value relative to that of Sample No. 1, which is set at 100. The gradation is defined by 1.75/x, wherein x is the difference of the logarithm of the exposure necessary to obtain the density of fog plus 2.0 and the logarithm of the exposure necessary to obtain the density of fog plus 0.25. The fog value includes the base density.

TABLE 1

| Sample No. | Fog | Sensitivity | Gradation |
|---|---|---|---|
| 1 | 0.15 | 100 | 2.6 |
| 2 | 0.15 | 95 | 2.7 |
| 3 | 0.15 | 120 | 3.0 |
| 4* | 0.15 | 114 | 3.1 |
| 5 | 0.15 | 100 | 2.8 |
| 6 | 0.15 | 95 | 2.9 |

TABLE 2

| Sample No. | Fog | Sensitivity | Gradation |
|---|---|---|---|
| 1 | 0.18 | 100 | 3.2 |
| 2 | 0.15 | 95 | 3.5 |

TABLE 2-continued

| Sample No. | Fog | Sensitivity | Gradation |
|---|---|---|---|
| 3 | 0.18 | 120 | 3.2 |
| 4* | 0.15 | 114 | 3.5 |
| 5 | 0.18 | 100 | 3.2 |
| 6 | 0.15 | 95 | 3.5 |

TABLE 3

| Sample No. | Fog | Sensitivity | Gradation |
|---|---|---|---|
| 1 | 0.30 | 100 | 3.0 |
| 2 | 0.17 | 95 | 4.1 |
| 3 | 0.30 | 120 | 3.0 |
| 4* | 0.17 | 114 | 4.5 |
| 5 | 0.30 | 100 | 3.0 |
| 6 | 0.17 | 95 | 4.5 |

*Invention

As shown in Tables 1 to 3, the comparison in the same procedure reveals that E-2 which was prepared at lower pH and in which a dye was added before chemical ripening provides the highest sensitivity and the higher gradation. In case of the Coating Procedure A, however, the conditions of the KBr of 2 g/liter and the processing time of 3 minutes and 30 seconds increase fog. The combination of the emulsion E-2 and the Coating Procedure B results in the characteristics of the lower fog and the higher gradations in every development procedure.

Further, the same samples which were adjusted to the humidity of 60% were packed tightly in a black anti-humidity polyethylene bag to stand for ten days at 50° C. Then the samples were subjected to the development processing with the processing machine FM 4000 using the developing solution RD-V containing KBr of 4 g/liter at 35° C. for the processing time of 90 seconds on a dry to dry base. The photographic properties of the processed samples were evaluated and the results thereof are shown in Table 4.

TABLE 4

| Sample No. | Fog | Sensitivity | Gradation |
|---|---|---|---|
| 1 | 0.30 | 100 | 2.2 |
| 2 | 0.17 | 100 | 2.7 |
| 3 | 0.30 | 105 | 2.5 |
| 4* | 0.15 | 120 | 3.0 |
| 5 | 0.30 | 100 | 2.4 |
| 6 | 0.15 | 115 | 2.8 |

*Invention

It is apparent from the above results that the Coating Procedure B controls an increase in fog and that among the above combinations of the emulsions and the coating procedures, that of E-2 and the procedure B (Sample No. 4) can provide the higher sensitivity and gradation as well as the lower fog. Accordingly, it can be found that an anti-aging property is improved.

It is obvious from all of the above results that the condition in which the pH is lower than 5.3 apparently deteriorates the coating property while a pH exceeding 6.0 lowers the sensitivity and gradation. Therefore a pH condition of 5.4 to 6.0 is preferable.

Further, a comparison of Sample Nos. 1 and 3 and Sample Nos. 2 and 4 shows that the dye added before adding the chemical sensitizer gives a higher gradation at the processing time of 90 seconds and a higher sensitivity at the processing time, either of 90 seconds or 3 minutes and 30 seconds. Accordingly, it can be found that the dye is added preferably before adding the chemical sensitizer.

The effect of adding Compound (II) is apparent from the comparisons of Sample Nos. 1, 3 and 5 and Sample Nos. 2, 4 and 6. Any emulsions to which Compound (II) was added, show reduced fog and no increase in fog even after aging.

In summary, the emulsions in which the sensitizing dye is added to the emulsion under the conditions of a pH 5.3 to 6.0 before adding the chemical sensitizer, followed by chemically sensitizing and further adding a compound of formula (II), can provide higher sensitivities and gradations and lower fogs, while giving excellent aging stability to the finished products.

EXAMPLE 2

The procedure of Example 1 was repeated except that Dye (I) was replaced with Dye (III) and Compound (II) with Compound (IV):

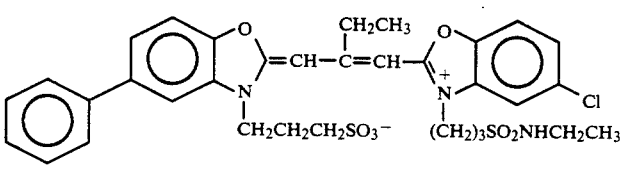

Dye (III)

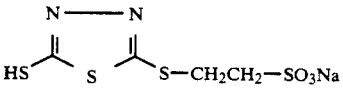

Compound (IV)

As in Example 1, Dye (III) was added to the above emulsion after chemically sensitizing at pH 5.5 to thereby prepare the Emulsion E'-1.

Dye (III) was added to the non-CR emulsion at 57° C. and pH of 5.5, followed by chemical sensitization, to thereby prepare the Emulsion E'-2.

Dye (III) was added to the non-CR emulsion at 57° C. and pH of 6.1, followed by chemical sensitization, to thereby prepare the Emulsion E'-3.

Next, 4-hydroxy-6-methyl-1,3,3a,7-tetrazaindene and a coating aid were added to the emulsions thus prepared (the coating procedure A'). Further, sodium 2-mercapto-5-ethylmercaptosulfonate-1,3,4-thiazole of Compound (IV) was added thereto in the amount of 0.5 millimole/mole Ag (the coating procedure B').

The coating solution for the protective layer was a gelatin solution prepared in the same manner as Example 1. The emulsion layer and protective layer were coated in the same manner as Example 1 on a PET support having an anti-halation layer coated on the side opposite to the emulsion layer so that the silver amount coated on one side was 4.5 g/m$^2$.

The emulsions and coating procedures were combined as shown in the following table to prepare the six samples.

| Sample No. | Em No. | Coating procedure |
|---|---|---|
| 1 | E'-1 | A' |
| 2 | E'-1 | B' |
| 3 | E'-2 | A' |
| 4* | E'-2 | B' |
| 5 | E'-3 | A' |
| 6 | E'-3 | B' |

*Invention

The samples thus prepared were subjected to development processing in the same manner as in Example 1 at 35° C. for a processing time of 90 seconds. The photographic characteristics were evaluated and the results thereof are shown in Table 1'.

The samples were subjected to the development processing under the condition of KBr 4 g/liter at 37° C. for 3 minutes 30 seconds. The evaluation results are shown in Table 2'.

The samples were subjected to the development processing under the condition of KBr 2 g/liter at 37° C. for 3 minutes 30 seconds. The evaluation results are shown in Table 3'.

TABLE 1'

| Sample No. | Fog | Sensitivity | Gradation |
|---|---|---|---|
| 1 | 0.15 | 100 | 2.6 |
| 2 | 0.15 | 95 | 2.7 |
| 3 | 0.15 | 120 | 3.0 |
| 4* | 0.15 | 114 | 3.1 |
| 5 | 0.15 | 100 | 2.8 |
| 6 | 0.15 | 95 | 2.9 |

TABLE 2'

| Sample No. | Fog | Sensitivity | Gradation |
|---|---|---|---|
| 1 | 0.18 | 100 | 3.2 |
| 2 | 0.15 | 95 | 3.5 |
| 3 | 0.18 | 120 | 3.2 |
| 4* | 0.15 | 114 | 3.5 |
| 5 | 0.18 | 100 | 3.2 |
| 6 | 0.15 | 95 | 3.5 |

TABLE 3'

| Sample No. | Fog | Sensitivity | Gradation |
|---|---|---|---|
| 1 | 0.30 | 100 | 3.0 |
| 2 | 0.17 | 95 | 4.1 |
| 3 | 0.30 | 120 | 3.0 |
| 4* | 0.17 | 114 | 4.5 |
| 5 | 0.30 | 100 | 3.0 |
| 6 | 0.17 | 95 | 4.5 |

*Invention

It can be found from the above results that Example 2 gives the same results as those of Example 1 and that the combination of the emulsions prepared by adding the dye at a lower pH before chemical ripening according to procedure B', in which Compound (IV) was added, provide the characteristics of higher sensitivity and gradation and lower fog.

Next, as in Example 1, Sample Nos. 1 to 6, which were adjusted to a humidity of 60 %, were packed tightly in a black anti-humidity polyethylene bag to stand at 50° C. for 10 days.

Then, as in Example 1, the samples were subjected to development processing with a processing machine FPM 4000 using RD-V containing KBr of 4 g/liter as the developing solution at 35° C. for 90 seconds. The photographic characteristics of the processed samples were evaluated and the results thereof are shown in Table 4'.

TABLE 4'

| Sample No. | Fog | Sensitivity | Gradation |
|---|---|---|---|
| 1 | 0.30 | 100 | 2.2 |
| 2 | 0.17 | 100 | 2.7 |
| 3 | 0.30 | 105 | 2.5 |
| 4* | 0.15 | 120 | 3.0 |
| 5 | 0.30 | 100 | 2.4 |
| 6 | 0.15 | 115 | 2.8 |

*Invention

The procedure B' is likely to prevent an increase in the fog even after aging, and Sample 4 in which E'-2 and the procedure B' were combined gives higher sensitivity and gradation and lower fog. That means that the anti-aging characteristics have been improved.

In summary, as in Example 1, the emulsions of Example 2, in which the sensitizing dye was added under the condition of pH 5.3 to 6.0 before adding the chemical sensitizer, followed by chemical sensitization and the further addition of a compound of formula (II), can provide higher sensitivity and gradation and lower fog, while giving excellent aging stability to the finished products.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one silver halide emulsion layer, wherein the emulsion is spectrally sensitized at a pH of 5.3 to 6.0 by adding at least one oxacarbocyanine dye represented by the following formula (I) before the addition of a chemical sensitizer and thereafter chemically sensitized by adding a chemical sensitizer; and wherein a compound represented by the following formula (II) is present in the emulsion layer or a layer adjacent thereto:

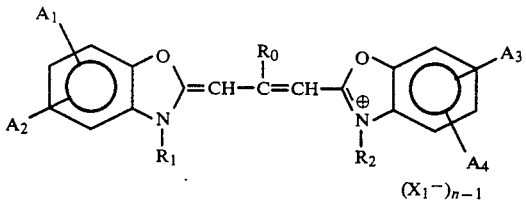

(I)

-continued wherein $A_1$, $A_2$, $A_3$ and $A_4$ each represents a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamide group, an acyl group, an acyloxyl group, an alkoxycarbonylamino group, and a carboalkoxy group, provided that $A_1$ and $A_2$, and $A_3$ and $A_4$ may combine with each other to form a naphthoxazole nucleus; $R_0$ represents a hydrogen atom, a lower alkyl group, and an aryl group; $R_1$ and $R_2$ each represents an alkyl group, provided that at least one of $R_1$ and $R_2$ is an alkyl group having a sulfo radical; $X_1$ represents an anion; and n is 1 or 2, provided that when the dye forms an inner salt, n is 1;

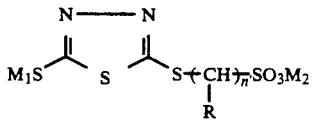

(II)

wherein $M_1$ and $M_2$ each represents a hydrogen atom, an alkali metal atom, and an ammonium ion; n' represents an integer of 1 to 8; and R represents a hydrogen atom or an alkyl group having 1 to 6 carbon atoms, provided that R may be different from each other when n' is 2 or more.

2. The silver halide photographic light-sensitive material according to claim 1, wherein n' in formula (II) is an integer of 1 to 4.

3. The silver halide photographic light-sensitive material according to claim 1, wherein R in formula (II) represents an alkyl group of 1 to 4 carbon atoms.

4. The silver halide photographic light-sensitive material according to claim 1, wherein the compound of formula (I) is present in an amount of 0.05 to 5 millimole per mole of silver in the emulsion layer, and the compound of formula (II) is present in an amount of 0.01 to 5 millimole per mole of silver in the emulsion layer or a layer adjacent thereto.

5. The silver halide photographic light-sensitive material according to claim 1, wherein chemical sensitization of the emulsion is performed at a pH of 5.4 to 5.6.

6. The silver halide photographic light-sensitive material according to claim 1, wherein the dye of formula (I) is added to the emulsion at a pH of 5.4 to 5.6.

7. The silver halide photographic light-sensitive material according to claim 1, wherein the material is in the form of an X-ray-sensitive material.

* * * * *